United States Patent [19]

Nozato

[11] Patent Number: 4,583,514

[45] Date of Patent: Apr. 22, 1986

[54] BALL THROWING MACHINE

[76] Inventor: Fujio Nozato, 33-20, Izuo 1-chome, Taisho-ku Osaka-shi, Osaka-fu, Japan

[21] Appl. No.: 568,164

[22] Filed: Jan. 4, 1984

[30] Foreign Application Priority Data

Jul. 25, 1983 [JP] Japan ..... 58-115962[U]

[51] Int. Cl.[4] ..... F41B 3/00

[52] U.S. Cl. ..... 124/78; 474/114

[58] Field of Search ..... 124/78, 6, 49, 82; 474/114; 74/16; 192/10, 11

[56] References Cited

U.S. PATENT DOCUMENTS

| | | | |
|---|---|---|---|
| Re. 28,462 | 7/1975 | Halstead | 124/78 |
| 528,608 | 11/1894 | Richter | 474/114 |
| 1,666,135 | 4/1928 | Hall | 474/114 |
| 1,708,903 | 4/1929 | Schroder | 474/114 |
| 2,283,153 | 5/1942 | Koch | 474/114 X |
| 2,475,115 | 7/1949 | Van Eaton | 474/114 X |
| 2,614,433 | 10/1952 | Cuckler | 474/114 X |
| 2,737,072 | 3/1956 | Caretta | 474/114 X |
| 2,918,915 | 12/1959 | Doeg | 124/78 |
| 3,757,759 | 9/1973 | Haworth | 124/82 |
| 3,785,358 | 1/1974 | D'Angelo et al. | 124/78 |
| 3,817,235 | 6/1974 | Blake | 124/78 |
| 3,878,828 | 4/1975 | Francesco | 124/49 X |

FOREIGN PATENT DOCUMENTS

| | | | |
|---|---|---|---|
| 252134 | 2/1970 | U.S.S.R. | 124/78 |

*Primary Examiner*—Paul E. Shapiro

*Attorney, Agent, or Firm*—Armstrong, Nikaido, Marmelstein & Kubovcik

[57] ABSTRACT

A pair of rotary wheels, a counter-rotating mechanism for rotating these rotary wheels in opposite directions, and a drive source for driving the rotary wheels through the counter-rotating mechanism are provided. A ball is nipped between the outer peripheral surfaces of the rotary wheels and is thereby thrown. The drive source is in the form of an engine having an output pulley, while the counter-rotating mechanism has an input pulley. A transmission belt is entrained around these pulleys.

3 Claims, 5 Drawing Figures

FIG. 3
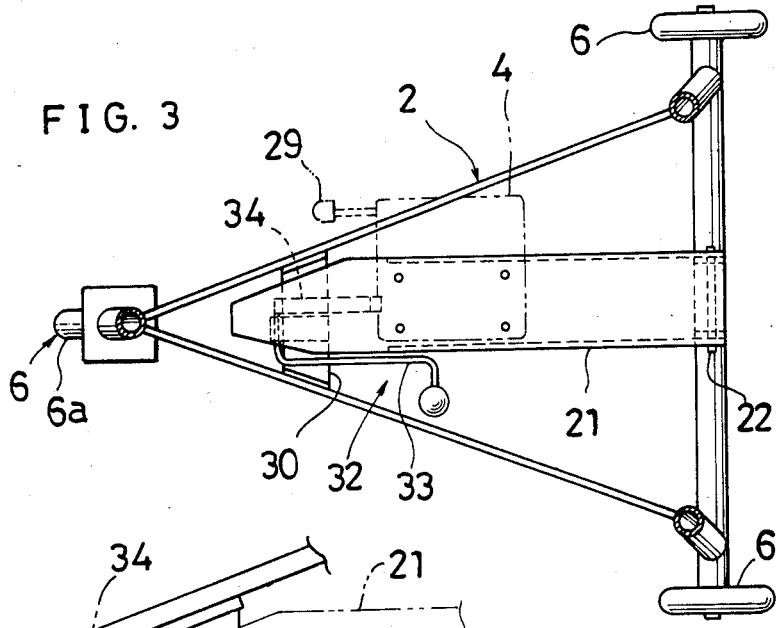
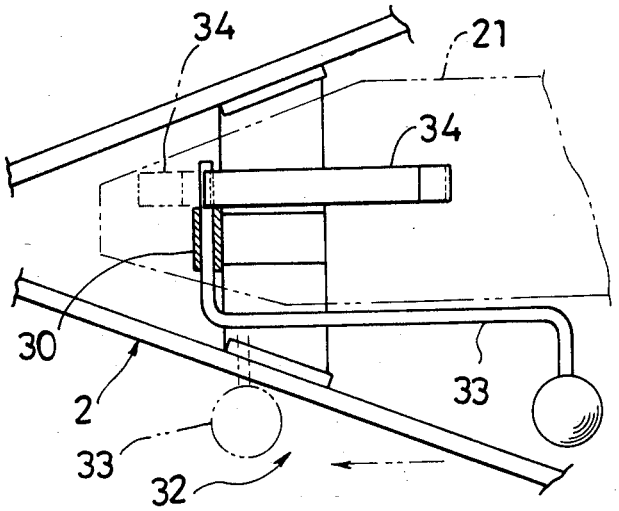
FIG. 4
FIG. 5
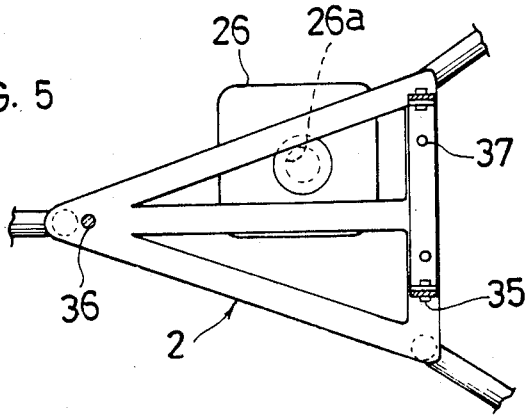

BALL THROWING MACHINE

BACKGROUND OF THE INVENTION

This invention relates to a ball throwing machine used for practicing batting balls or catching fly balls.

A prior art ball throwing machine is disclosed in U.S. Pat. No. 3,724,437. In the disclosed arrangement, a pair of counter-rotating wheels are driven by electric motors and a ball is nipped between the outer peripheral surfaces of the rotating wheels and thrown.

Generally, ball throwing machines are used often at places remote from an available electric power source, such as baseball grounds. In the aforesaid prior art arrangement, however, since electric motors are used, the use of said ball throwing machine is impossible or difficult at places which are lacking in or far away from an available electric power source.

SUMMARY OF THE INVENTION

An object of this invention is to make it possible to use a ball throwing machine at places lacking in an electric power source, such as baseball grounds, and to simplify the power transmitting means used in ball throwing machines.

Another object of the invention is to provide clutch means for allowing or cutting off power transmission, which clutch means is easy to operate.

A further object of the invention is to provide an arrangement for operatively connecting a pair of rotary wheels to an engine in such a manner as to prevent the vibration of the engine being transmitted to the rotary wheels, thereby ensuring accurate throwing of balls.

Another object of the invention is to make it possible to change the ball throwing direction and to facilitate such change of the ball throwing direction.

Another object of the invention is to facilitate supply of fuel to the engine. That is, in order to construct the ball throwing machine in compact form, the engine is installed so that it does not project considerably outwardly beyond the rotary wheels, a counter-rotating mechanism and an upper support platform to which these components are attached. A fuel tank is installed on top of the engine. In this case, supply of fuel to the fuel tank would be complicated owing to the presence of the upper support platform. Thus, it is an object of the invention to facilitate fuel supply.

Yet another object of the invention is to make it easy to disassemble and assemble the ball throwing machine and carry it around.

BRIEF DESCRIPTION OF THE DRAWINGS

The drawings illustrate a preferred embodiment of the invention.

FIG. 3 is a view taken along the line III—III in FIG. 2;

FIG. 4 is a partial enlarged view of FIG. 3; and

FIG. 5 is a view taken along the line V—V in FIG. 2.

DESCRIPTION OF THE PREFERRED EMBODIMENT

Figure 1:
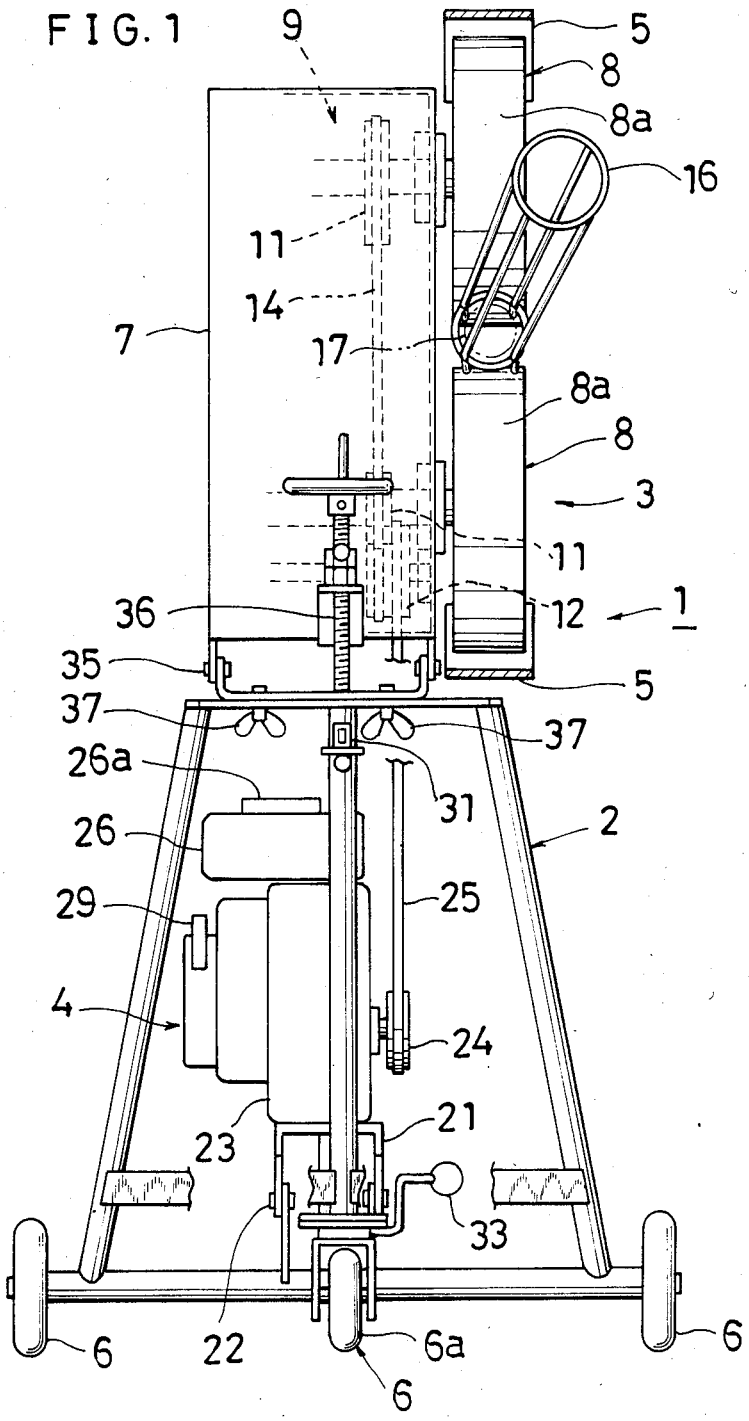
FIG. 1 is a front view of a ball throwing machine.

A ball throwing machine comprises a lower support platform 2, a main body 3 installed on said lower support platform, and an engine 4 serving as a drive source for driving said main body 3.

The lower support platform 2 is constructed so that it is triangular in plan view and trapezoidal in side view, and the engine 4 is attached to the lower support platform 2. Further, ground-engaging wheels 6 are attached to the bottom of said lower support platform 2. Of these wheels 6, the rear one **6*a* as viewed in the direction of travel (in the direction of arrow A in FIG. 2) is a caster to facilitate movement of the ball throwing machine 1**.

The main body 3 has a main body case 7 which is an upper support platform. A pair of upper and lower rotary wheels 8 are mounted on the main body case 7. These rotary wheels 8 are in the form of disks of the same shape and size turnable around respective parallel transverse axes. Each rotary wheel 8 has a safety cover 5 disposed around the outer periphery thereof.

Figure 2:
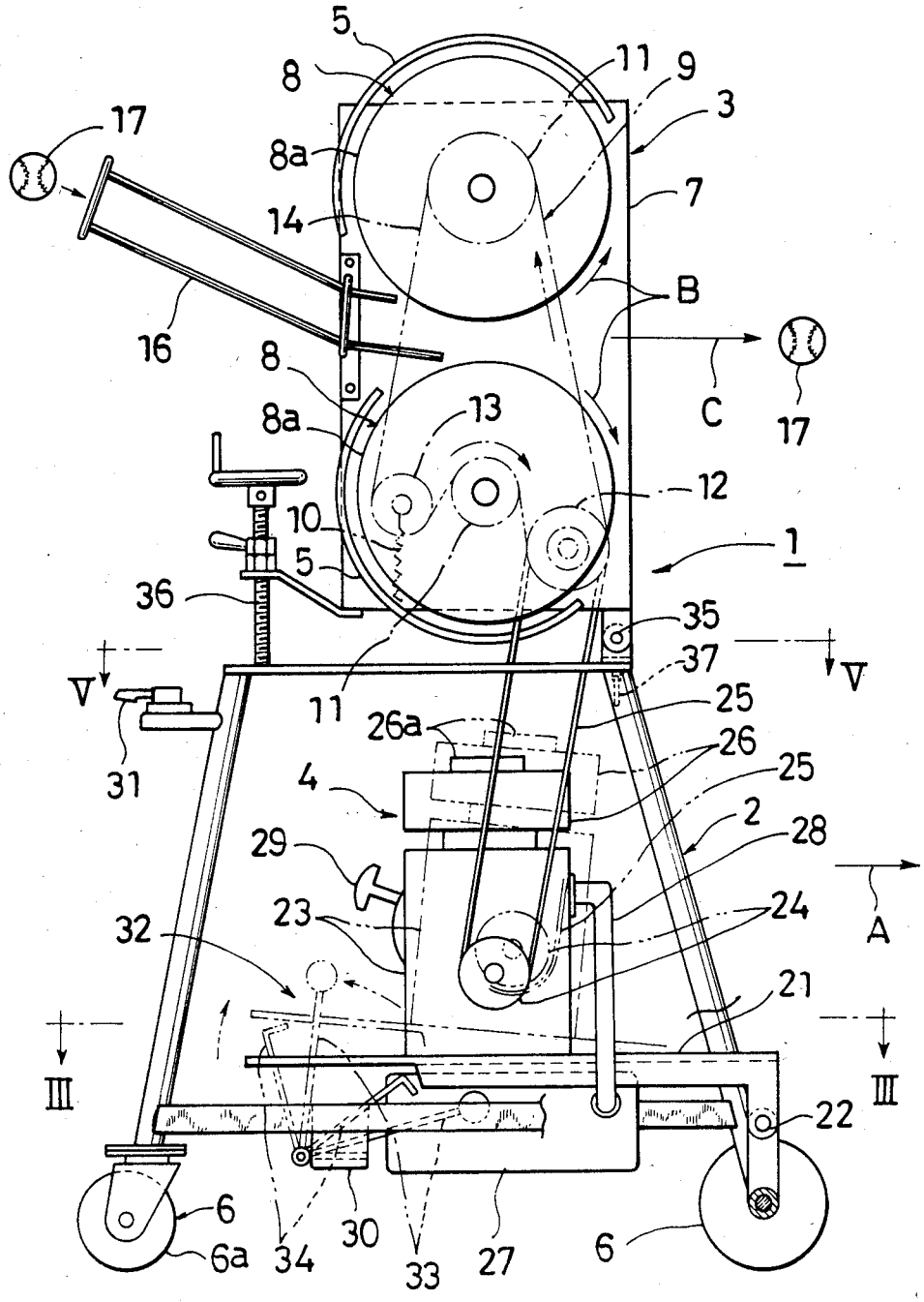
FIG. 2 is a side view of the ball throwing machine.

Installed in said main body case 7 is a counter-rotating mechanism 9 for rotating the rotary wheels 8 in opposite directions (indicated by arrows B in FIG. 2). The counter-rotating mechanism 9 comprises pulleys 11 respectively provided on the rotary wheels 8, an input pulley 12 journaled by the main body case 7, an idle pulley 13 urged by a spring 10, and a belt 14 entrained around these pulleys.

A ball 17 is guided into a space between the rotary wheels 8 through a feeder 16. The main body 3 is arranged to nip the ball 17 between the outer peripheral surfaces **8*a* of the rotary wheels 8 driven for rotation by the engine 4** and throw it.

The engine 4 is located within the frame of the lower support platform 2 and mounted on a support plate 21. The front end of the support plate 2 is pivotally supported by the lower support platform 2 through a pivot shaft 22, and the engine 4 can be vertically moved by vertically turning the rear end of the support plate 21.

The engine 4 is a gasoline engine and has an output pulley 24 mounted on the engine main body 23 thereof. A transmission belt 25 made of an elastic material such as rubber is entrained around the output pulley 24 and input pulley 12.

A fuel tank 26 is supported on said engine main body 26 and has an oil feed port **26*a* formed in its upper surface. Further, a silencer 27 attached to the lower surface of the support plate 21 is connected to an exhaust pipe 28. The numeral 29 denotes a recoil starter, and 31** denotes a throttle lever.

A description will now be given of clutch means for allowing or cutting off power transmission between the engine 4 and the rotary wheels 8. Upwardly turning the support plate 21 loosens the transmission belt 25 to thereby cut off power transmission between the pulleys 12 and 24 (as shown in phantom lines in FIG. 2). For example, the engine 4 is started with power transmission cut off in this manner. On the other hand, downwardly turning the support plate 21 results in the weights of the engine 4 and support plate 21 tightening the transmission belt 25, thereby allowing power transmission between the pulleys 12 and 24 (as shown in solid lines in FIG. 2). In this case, the transmission belt 25 absorbs the vibration of the engine 4 by its elasticity and slack. As a result, transmission of the vibration of the engine 4 to the rotary wheels 8 is prevented and hence the ball is accurately thrown by the rotary wheels.

An operating device 32 is used to upwardly or downwardly turn said support plate 21. Thus, the operating device 32 comprises an operating lever 33 pivotally connected to the lower support platform 2 through a bracket 30 so that it is turnable back and forth, and a push lever connected to said operating lever 33. The push lever 34 is smaller in radius of rotation than the operating lever 33.

Turning said operating lever 33 causes a turning of the push lever 34. The turning end of the push lever 34 contacts the lower surface of the support plate 21 while sliding on said lower surface, whereby the support plate 21 is turned upwardly or downwardly. In this case, an unillustrated stop is provided for preventing the operating lever 33 from further turning after having been turned to a predetermined position. Since the push lever 34 is shorter than the operating lever 33, the latter can be operated lightly.

The aforesaid main body case 7 is pivotally supported on the lower support platform 2 by pivot shafts 35 so that it can be upwardly and downwardly turned. The aforesaid input pulley 12 is positioned adjacent said pivot shafts 35. On the other hand, a screw jack 36 is provided at the turning end of the main body case 7 for upwardly and downwardly turning the main body case 7. The ball throwing direction (indicated by arrow C) in a vertical plane can be easily changed by operating the screw jack 36. Further, since the input pulley 12 is positioned adjacent the pivot shafts 35, the screw jack 36 can be lightly operated, while the vertical movement of the engine is minimized.

In the above case, since the engine 4 follows the movement of the main body case 7 through the transmission belt 25, there is no need to adjust the installed position of the engine 4 in changing the ball throwing direction. On the other hand, change of the ball throwing direction in a horizontal plane can be easily made by using the caster type ground-engaging wheel 6*a*.

The engine 4 is attached to the lower support platform 2 below the main body case 7. If the main body case 7 is turned forwardly (as shown in phantom lines in FIG. 2), the top of the fuel tank 26 is upwardly opened, making it easier to feed fuel to the tank through the oil feed port 26*a*.

The main body case 7 is removably attached to the lower support platform 2 by bolts 37. Thus, if the bolts 37 are removed and the transmission belt 25 is loosened and removed from the output pulley 24, then the main body 3 and the lower support platform 2 are separated from each other. As a result, it becomes easier to disassemble and assemble the ball throwing machine 1 and to carry it around.

What is claimed is:

1. A ball throwing machine including a pair of rotary wheels, a counter-rotating mechanism for rotating said wheels in opposite directions, and an engine for driving the rotary wheels through said counter-rotating mechanism, wherein a ball is nipped between the outer peripheral surfaces of the rotary wheels and is thereby thrown, said ball throwing machine being characterized in that said rotary wheels and counter-rotating mechanism are attached to an upper support platform, the engine is pivotally supported for vertical movement to a lower support platform, said engine has an output pulley, while said counter-rotating mechanism has an input pulley, with a transmission belt being entrained around said pulleys, the slack of the transmission belt caused by upward movement of the engine cuts off power transmission between the two pulleys, while the tightening of the transmission belt caused by downward movement and the weight of said engine allows power transmission between said pulleys, and said upper support platform being removably attached to the top of said lower support platform.

2. A ball throwing machine as set forth in claim 1, characterized in that the machine further includes an operating lever pivotally supported on the lower support platform, and a push lever smaller in radius of rotation than said operating lever and adapted to be turned together with said operating lever, the arrangement being such that the turning end of said push lever contacts the engine and pushes up the latter when the operating lever is turned.

3. A ball throwing machine as set forth in claim 1, characterized in that ground-engaging wheels are attached to the lower support platform, and of these ground-engaging wheels, the rear one as view in the direction of travel of the machine is a caster.

* * * * *